US008641269B2

(12) United States Patent
Girardin et al.

(10) Patent No.: US 8,641,269 B2
(45) Date of Patent: Feb. 4, 2014

(54) TIMEPIECE MECHANISM AND MODULE COMPRISING SUCH A MECHANISM

(75) Inventors: Frederic Johnny Girardin, Fontaines (CH); Franck-Charles-Cyril Orny, La Chaux-de-Fonds (CH); Daniel Martinez, La Chaux-de-Fonds (CH)

(73) Assignee: CT Time S.A., La Chaux-de-Fonds (CH)

( * ) Notice: Subject to any disclaimer, the term of this patent is extended or adjusted under 35 U.S.C. 154(b) by 454 days.

(21) Appl. No.: 12/993,972

(22) PCT Filed: May 14, 2009

(86) PCT No.: PCT/EP2009/055821

§ 371 (c)(1),
(2), (4) Date: Jan. 4, 2011

(87) PCT Pub. No.: WO2009/141262

PCT Pub. Date: Nov. 26, 2009

(65) Prior Publication Data

US 2011/0110199 A1 May 12, 2011

(30) Foreign Application Priority Data

May 22, 2008 (EP) ..... 08156728

(51) Int. Cl.
*G04B 27/02* (2006.01)
*G04B 27/04* (2006.01)

(52) U.S. Cl.
CPC ..... *G04B 27/04* (2013.01)
USPC ..... 368/190; 368/191

(58) Field of Classification Search
USPC ..... 368/185, 187, 190–199, 206, 308, 319, 368/145, 146
See application file for complete search history.

(56) References Cited

U.S. PATENT DOCUMENTS

| | | | | |
|---|---|---|---|---|
| 3,827,235 | A * | 8/1974 | Bachmann | 368/190 |
| 3,837,162 | A | 9/1974 | Meitinger | |
| 4,104,866 | A | 8/1978 | Chappatte | |
| 4,274,152 | A * | 6/1981 | Ikegami | 368/192 |
| 4,845,693 | A * | 7/1989 | Kubota | 368/185 |
| 7,134,783 | B2 * | 11/2006 | Schmiedchen et al. | 368/190 |
| 7,957,226 | B2 * | 6/2011 | Chaignat et al. | 368/35 |

FOREIGN PATENT DOCUMENTS

| | | |
|---|---|---|
| CH | 17991 A | 11/1898 |
| CH | 81927 A | 2/1919 |
| CH | 609516 A3 | 3/1979 |

OTHER PUBLICATIONS

International Search Report, dated Sep. 10, 2009, from corresponding PCT application.
European Search Report, dated Jan. 20, 2009, from corresponding PCT application.

* cited by examiner

*Primary Examiner* — Vit W Miska
(74) *Attorney, Agent, or Firm* — Young & Thompson

(57) ABSTRACT

A mechanism and a timepiece module independent of the bottom plate of a movement, of a simple and compact design. The timepiece mechanism includes a control stem (3) mounted in a pivoting manner and movable between at least two axial positions, a control pinion (11; 13) mounted so as to rotate with the control stem (3), and at least one actuating member (15, 24; 30) configured to engage with the control pinion (11; 13) when the control stem is occupying one of the axial positions. The control pinion (11; 13) is also coupled translationally to the control stem (3) when the latter moves from one to the other of the two positions. The module includes a case (2) containing the mechanism.

16 Claims, 5 Drawing Sheets

TIMEPIECE MECHANISM AND MODULE COMPRISING SUCH A MECHANISM

TECHNICAL FIELD

The present invention concerns a timepiece mechanism comprising a control stem mounted in a pivoting manner and movable between at least two axial positions, a control pinion mounted so as to rotate with said control stem, and at least one actuating organ configured to engage with said control pinion when the control stem is occupying one of the axial positions. The invention also concerns a module comprising such a mechanism.

BACKGROUND OF THE INVENTION

This type of mechanism is for example a winding and setting mechanism that traditionally comprises a winding stem on which a castle wheel, rotating with the winding stem, can slide between a winding position and a setting position. In the winding position, the castle wheel engages with a first actuating organ formed by a winding pinion and in the setting position, the castle wheel engages with an appropriate intermediate wheel that constitutes a second actuating organ. The different parts are positioned on the winding stem, from the outside towards the center of the movement in the following order: winding pinion, castle wheel, intermediate wheel for setting. The transition from one position to the other is done using a pull-out piece engaging with the winding stem and a lever whereof the end is housed in a notch provided on the castle wheel. The pull-out piece and the lever have the drawback of complicating the construction and operation of the mechanism.

It is known to produce this winding and setting mechanism in the form of an independent module that can be separated from the frame of a timepiece movement. Such a module is for example described in Swiss patent CH 81927, which presents a winding and setting mechanism whereof all of the components are fastened between two plates, forming a removable module. Swiss patent CH 17991 also describes a module made up of a removable bridge fastened on the plate of a watch, on which all of the pieces making up the winding and setting mechanisms are placed. However, these modules have the same drawbacks as those encountered by the traditional winding and setting mechanisms, due to the presence of the pull-out piece and lever.

Also known from patent CH 609 516 is a timepiece mechanism comprising a stem that can move between three axial positions and two pinions rotating with the rod and integral in translation during movements of the rod, each of these pinions engaging with a single actuating organ to perform a single function, i.e. the setting and actuating of the date. The control stem is mounted in a bracket fastened directly to the plate of the movement. The positioning of the stem must be precise so that the control pinions mounted on the stem engage correctly with their actuating organs positioned around the stem. Moreover, if one wishes to modify the position of the stem on the frame of the movement, it is also necessary to revise the position of the actuating organs that engage with the control pinions positioned on the stem. It is therefore necessary generally to revise the entire design of the movement.

One aim of the present invention is therefore to offset these drawbacks, by proposing a module comprising a setting and winding mechanism, and more generally for actuating a function of a timepiece movement, allowing a simplified construction and operation.

Another aim of the present invention is to propose a timepiece module independent of the frame of a movement, with a simple and compact design, easily removable to be able to be used on any type of movement, without having to revise the design of the movement.

BRIEF DESCRIPTION OF THE INVENTION

To that end, and according to the present invention, proposed is a module for actuating an element of a timepiece movement, intended to be mounted on a frame of said movement, said module containing a mechanism comprising a control stem mounted in a pivoting manner and movable between at least two axial positions, a control pinion mounted so as to rotate with said control stem, and at least one actuating organ configured to engage with said control pinion when the control stem is occupying one of the axial positions, said control pinion also being translationally secured to said control stem when the latter moves from one to the other of said two positions. According to the invention, said module also comprises an independent case in which said mechanism is contained, and connecting means leaving the case and configured to be able to kinematically connect the actuating organ to the element of the movement to be actuated, such that said actuating organ can actuate said element regardless of the position of the module on the frame of the movement.

The module according to the invention is particularly compact, removable and easily interchangeable. The control pinion and its actuating organ being mounted together in the case, their engagement is always guaranteed, regardless of the position of the module. The connection between the element to be actuated and the module can be ensured directly by the connecting means present on the module or by simply adding other intermediate wheels, simply and precisely guaranteeing the transmission of the information coming from the control pinion and its actuating organ via the connecting means incorporated in the module, regardless of the module's position.

Particularly advantageously, the connecting means can be mounted on the housing so that they can be oriented.

According to a first alternative embodiment, the element to be actuated can be made up of display organs, and the corresponding actuating organ can comprise a setting wheel mounted freely rotating on the control stem, the control pinion comprising, on its face opposite the setting wheel, a toothing able to engage with the toothing of the setting wheel to correct the time. The connecting means between the setting wheel and the display organs can comprise at least one intermediate wheel mounted freely rotating on the case.

According to another alternative embodiment, the element to be actuated can be a barrel spring, and the corresponding actuating organ can comprise a winding pinion configured to be able to be kinematically and at least temporarily connected to said barrel spring by the connecting means, said winding pinion being mounted freely rotating on the control stem, the control pinion comprising, on its face opposite the winding pinion, a toothing able to engage with said winding pinion for the winding of said movement. The connecting means between the winding pinion and the barrel spring can comprise a tongue protruding from the case and mounted rotationally mobile on said case, said tongue supporting at least one intermediate wheel configured on one hand to mesh with the winding pinion and on the other hand to be able to be kinematically and at least temporarily connected to said barrel spring.

According to another alternative embodiment, the mechanism can comprise at least two actuating organs, one to correct the time and the other for winding, like those described above, and the control pinion is then positioned such that, on the control stem, from the outside towards the center, are the setting wheel, the control pinion and the winding pinion.

According to another alternative embodiment, the actuating organ can comprise a rack able to move perpendicularly to the control stem in a bidirectional movement, said rack comprising the connecting means configured to engage with the element to be actuated, and the control pinion can comprise a toothing able to engage with the toothing of the rack so as to move said rack and its connecting means.

Preferably, the toothing of the rack is chosen such that, in one position, the control pinion engages with the rack, and the control pinion can pass through the toothing of the rack to reach the other position.

According to another alternative embodiment, the mechanism can comprise a first control pinion for setting and winding and a second control pinion configured to engage with a rack to actuate another element of the timepiece movement like those described above, the first and second control pinions being positioned such that, on the control stem, from the outside towards the center, are the second control pinion, the setting wheel, the first control pinion and the winding pinion, and the control stem can move between three axial positions, a first position according to which the first control pinion meshes with the winding pinion, a second position according to which the second control pinion meshes with the rack, and a third position according to which the first control pinion meshes with the setting wheel, the second control pinion having passed through the toothing of the rack.

Preferably, the mechanism also comprises a selector spring engaging with the control stem and with a positioning organ to define the positions of the control stem.

Advantageously, the control stem can comprise a first removable element and a second element housed inside the case.

The present invention also concerns a timepiece movement mechanism usable in the actuating module as described above, comprising a control stem mounted in a pivoting manner and movable between at least two axial positions, a control pinion mounted so as to rotate with said control stem, and at least one actuating organ configured to engage with said control pinion when the control stem is occupying one of the axial positions, said control pinion also being secured in translation with said control stem when the latter moves from one to the other of said two positions. The actuating organ is configured to be kinematically connected to display organs of a timepiece movement, and comprises a setting wheel mounted freely rotating on the control stem, the control pinion comprising, on its face opposite the setting wheel, a toothing able to engage with the toothing of the setting wheel to correct the time.

The present invention also concerns a timepiece movement mechanism usable in the module as defined above, comprising a control stem mounted in a pivoting manner and movable between at least two axial positions, a control pinion mounted so as to rotate with said control stem, and at least one actuating organ configured to engage with said control pinion when the control stem is occupying one of the axial positions, said control pinion also being translationally secured to said control stem when the latter moves from one to the other of said two positions. The actuating organ comprises a winding pinion configured to be able to be kinematically and at least temporarily connected to a barrel spring of a timepiece movement, said winding pinion being mounted freely rotating on the control stem, the control pinion comprising, on its face opposite the winding pinion, a toothing able to engage with said winding pinion to wind said movement.

Advantageously, the mechanism can comprise at least two actuating organs, one to correct the time and the other for winding, and the control pinion is positioned such that, on the control stem, from the outside towards the center, are the setting wheel, the control pinion and the winding pinion.

The present invention also concerns a timepiece movement mechanism usable in the module as defined above, comprising a control stem mounted in a pivoting manner and movable between at least two axial positions, a control pinion mounted so as to rotate with said control stem, and at least one actuating organ configured to engage with said control pinion when the control stem is occupying one of the axial positions, said control pinion also being integral in translation with said control stem when the latter part moves from one to the other of said two positions. The actuating organ comprises a rack able to move perpendicularly to the control stem in a bidirectional movement, said rack comprising the connecting means configured to engage with the element to be actuated, the control pinion comprising a toothing able to engage with the toothing of the rack so as to move said rack and its connecting means.

In one alternative embodiment, the mechanism can comprise a first control pinion for setting and winding and a second control pinion configured to engage with a rack to actuate another element of the timepiece movement, the first and second control pinions being positioned such that, on the control stem, from the outside towards the center, are the second control pinion, the setting wheel, the first control pinion and the winding pinion, and the control stem being movable between three axial positions, a first position according to which the first control pinion meshes with the winding pinion, a second position according to which the second control pinion meshes with the rack, and a third position according to which the first control pinion meshes with the setting wheel, the second control pinion having passed through the toothing of the rack.

The present invention also concerns a timepiece comprising a module as defined above.

BRIEF DESCRIPTION OF THE DRAWINGS

Other features of the present invention will appear more clearly upon reading the following description, done in reference to the appended drawings, in which.

DETAILED DESCRIPTION OF THE INVENTION

Described in reference to the figures is an embodiment of the mechanism and the timepiece module according to the invention, according to which the mechanism and the module comprise two control pinions and three actuating organs, i.e.

a winding pinion, a setting wheel and a rack for actuating one other function, the control stem then being able to occupy three positions.

Figure 1:
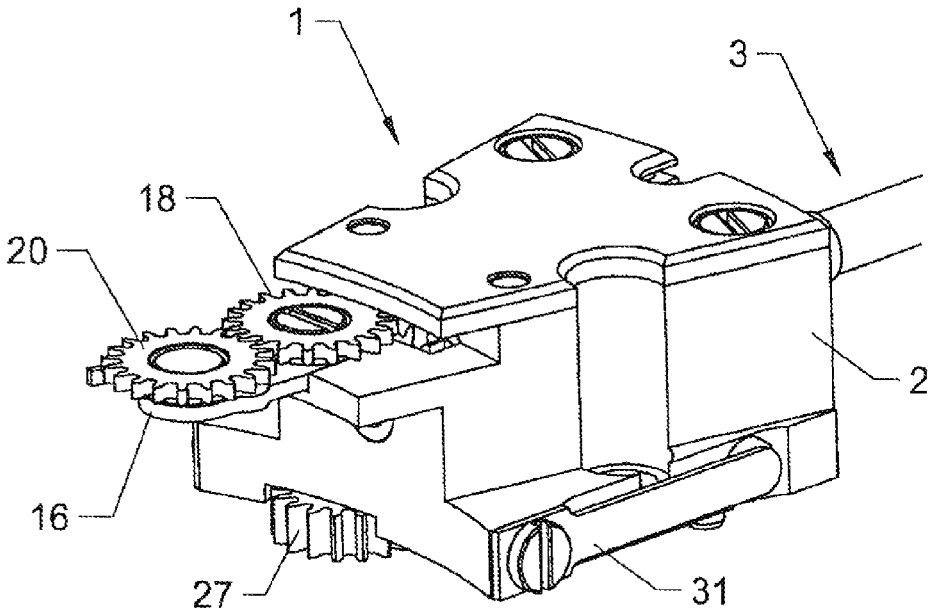
FIGS. 1 and 2 are perspective views showing the top and bottom of a module according to the invention, respectively.
Figure 2:
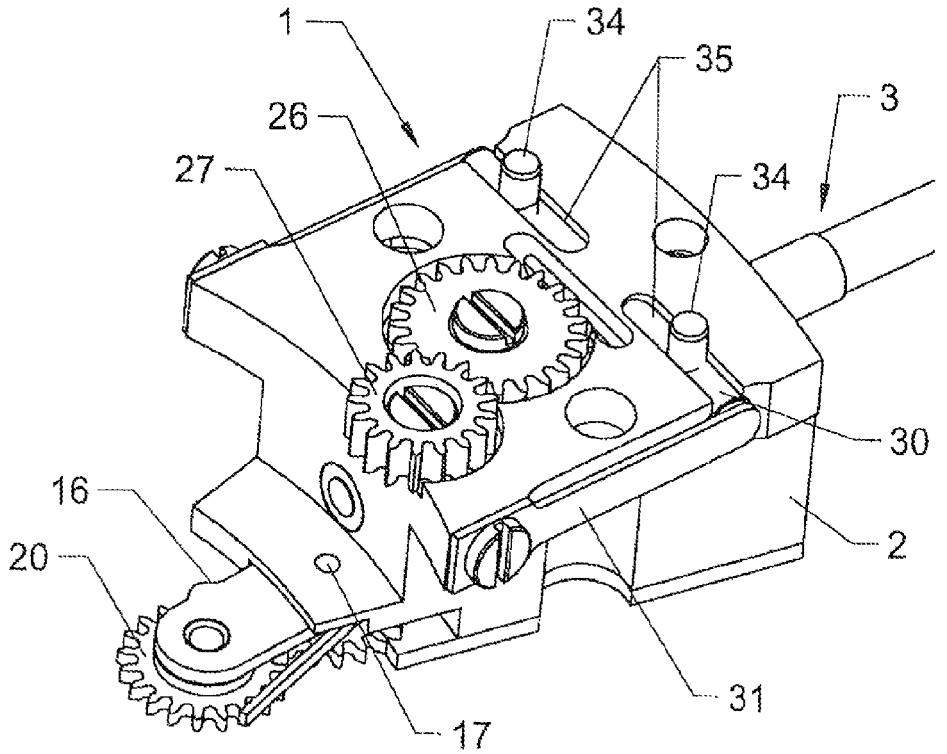

FIGS. 1 and 2 show a module 1 according to the invention comprising a case 2 and a mechanism for actuating an element of a timepiece movement.

Figure 5:
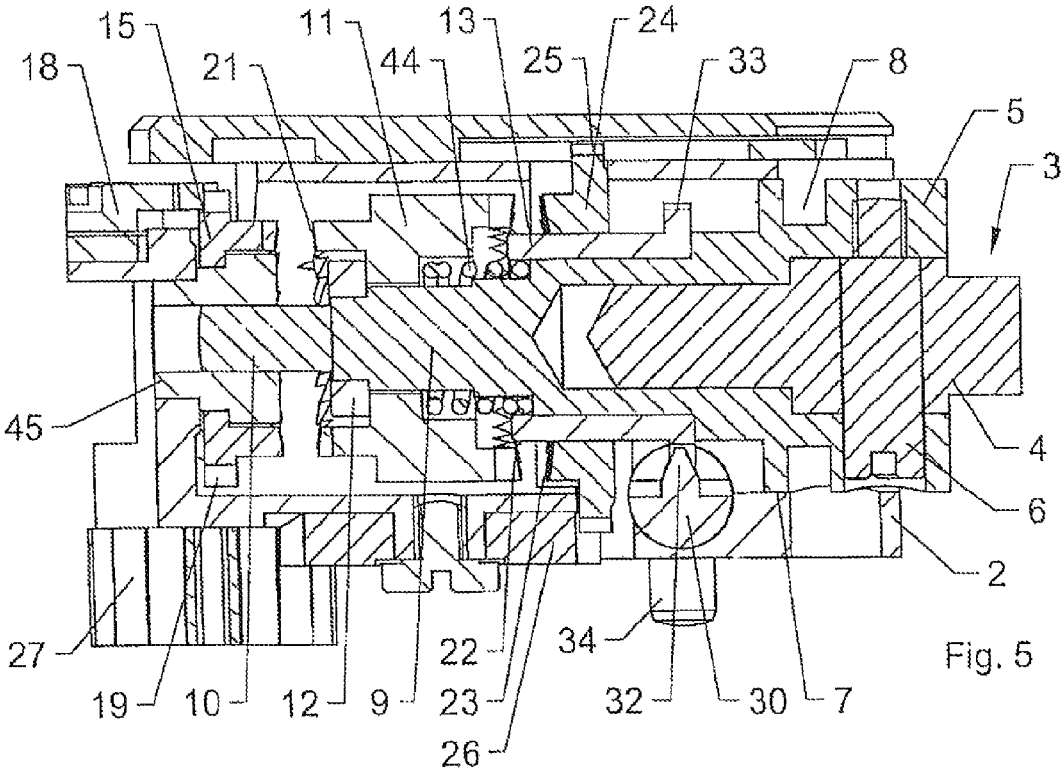
FIGS. 5 and 6 are a cross-sectional and top view of the module of the invention, respectively, the control stem being in a second position for actuating another function.

In FIG. 5, the mechanism according to the invention comprises a control stem 3 mounted, inside the case 2, pivoting in the plane of the timepiece, and translationally movable between three axial positions. The control stem 3 comprises a first element 4 and a second element 5 essentially housed inside the case 2. The first element 4 is configured removably inside the second element 5 so as to be easy to disassemble and so that it is easy to remove the movement from its case. The elements 4 and 5 of the stem are secured using a screw 6. Obviously the elements 4 and 5 can be replaced by any other broken stem device. The second element 5 of the control stem 3 has a first cylindrical zone 7 comprising a circular slot 8 whereof the operation will be explained later. The element 5 then has a square 9, then a second cylindrical zone 10. On the square 9 is mounted a first control pinion 11, which therefore rotates with the control stem 3. Moreover, a ring 12 is provided driven onto the element 5 of the control stem 3 and a helical spring 44 configured to keep the control pinion 11 in contact with the ring 12 so as to make the control pinion 11 translationally secured with said control stem 3 when it moves between its three axial positions. Driven onto the cylindrical portion 7 of the element 5 of the control stem 3 is a toothed socket 13, constituting a second control pinion rotating with and translationally secured to the control stem 3.

A first actuating organ is formed by a winding pinion 15. Said winding pinion 15 is mounted freely rotating on the element 5 of the control stem 3 on the side of a timepiece movement (not shown) and is blocked in translation using a bearing 45 having a suitable shape and driven onto the case 2. The winding pinion 15 is configured to be able to be kinematically and at least temporarily connected to a barrel spring (not shown) of said movement. To that end, as shown by FIG. 1 or 2, provided on one side of the winding pinion 15 is a tongue 16 protruding from the case 2 and mounted freely rotating about a pivot 17 on the case 2. Said tongue 16 supports two intermediate wheels, a first intermediate wheel 18 configured to mesh with the toothing 19 of the winding pinion 15, and a second intermediate wheel 20 configured to be able to be kinematically and at least temporarily connected to the barrel spring. In an automating winding movement, the tongue 16 can tilt and release the intermediate wheel 20 from the ratchet of the barrel so as to disengage and avoid rotating the control stem 3 during the automatic winding.

On their opposite faces, the winding pinion 15 and the control pinion 11 comprise a Breguet toothing 21 allowing the control pinion 11 to engage with the winding pinion 15 to wind the movement when the control stem 3 is in the winding position. Owing to the Breguet toothing, the meshing between the control pinion 11 and the winding pinion 15 only occurs when the control stem 3 is turned in the winding direction. In the other direction, the control pinion 11 can rotate without driving the winding pinion 15.

On its other face, the control pinion 11 comprises a contrate toothing 22 opposite and able to engage with a contrate toothing 23 of a setting wheel 24. Said setting wheel 24 is mounted freely rotating on the toothed socket 13 of the element 5 of the control stem 3 and constitutes a second actuating organ to correct the time. To do this, the setting wheel 24 comprises a toothing 25 and is positioned so that the toothing 25 meshes with an intermediate wheel 26 mounted freely rotating on the case 2, itself meshing with an intermediate wheel 27 mounted freely rotating on the case 2 and kinematically connected to display organs (not shown) of the timepiece movement.

In this alternative, the module 1 comprises a third actuating organ formed by a rack 30, generally cylindrical. Said rack 30 is able to move perpendicularly to the control stem 3 in a front-to-back bidirectional movement, and is maintained by two strip springs 31 fastened on either side of the case 2 (cf. FIG. 2). The rack comprises a toothing 32 able to engage with the toothing 33 of the toothed socket 13. The toothing 32 of the rack is pyramid-shaped such that it can be passed through by the toothing 33 of the toothed socket 13 while avoiding any collision, when the control stem 3 is moved to occupy the third position, as will be seen later.

In the illustrated alternative, the actuating means of the rack 30 are formed by two actuating fingers 34 provided on the cylindrical body of the rack. These actuating fingers 34 protrude from the case 2, which comprises two channels 35 in which said actuating fingers 34 can circulate. The actuating fingers 34 are configured to engage with a mechanism (not shown) of the timepiece movement, which can for example be a date correction mechanism of a calendar, a mechanism for activating a minute repeater, a triggering mechanism for a chronograph, etc.

Obviously the actuating means of the rack can also be made up of an inverse system, i.e. a slot provided on the body of the rack configured to be able to move pins engaging with a mechanism of the timepiece movement.

The control pinion 11 and the toothed socket 13 are positioned on the control stem 3 such that, on the control stem 3, from the outside towards the center, are the toothed socket 13, the setting wheel 24, the control pinion 11 and the winding pinion 15, and such that the rack 30 is located before the toothed socket 13 when the control stem 3 occupies the first winding position and between the setting wheel 24 and the toothed socket 13, when the control stem 3 occupies the third setting position.

To define the different positions of the control stem 3, a selector spring 40 is provided secured to two pins 41 that plunge into the slot 8 of the element 5 of the control stem 3, such that the selector spring 40 follows the translational movements of the control stem 3. The ends 43 of the selector spring 40 are configured to engage with a positioning organ 42 that comprises three indexing elements on which the ends 43 of the selector spring 40 can engage, thereby defining the three positions of the control stem 3.

All of the elements of the mechanism are dimensioned and positioned to be able to contain in the case 2 and constitute a particularly compact mechanism and module.

All of the elements of the mechanism being grouped together in a same module, this module 1 is independent of the rest of the timepiece movement and can be easily removed to be replaced.

Figure 9:
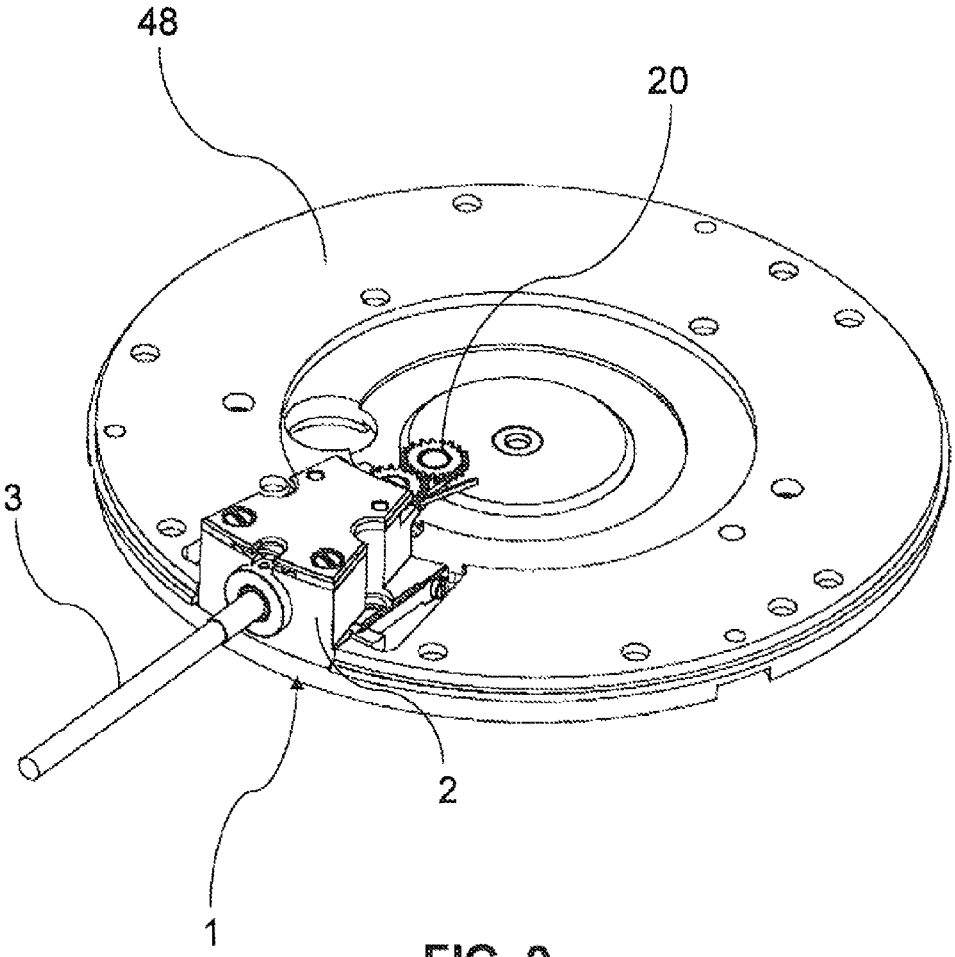
FIG. 9 is a perspective view showing the module according to the invention mounted in a housing provided on the plate of a movement.

In reference to FIG. 9, the module 1 is then positioned on the frame, for example the plate 48, at the appropriate location to be able to engage with the element(s) of the movement to be actuated.

Figure 3:
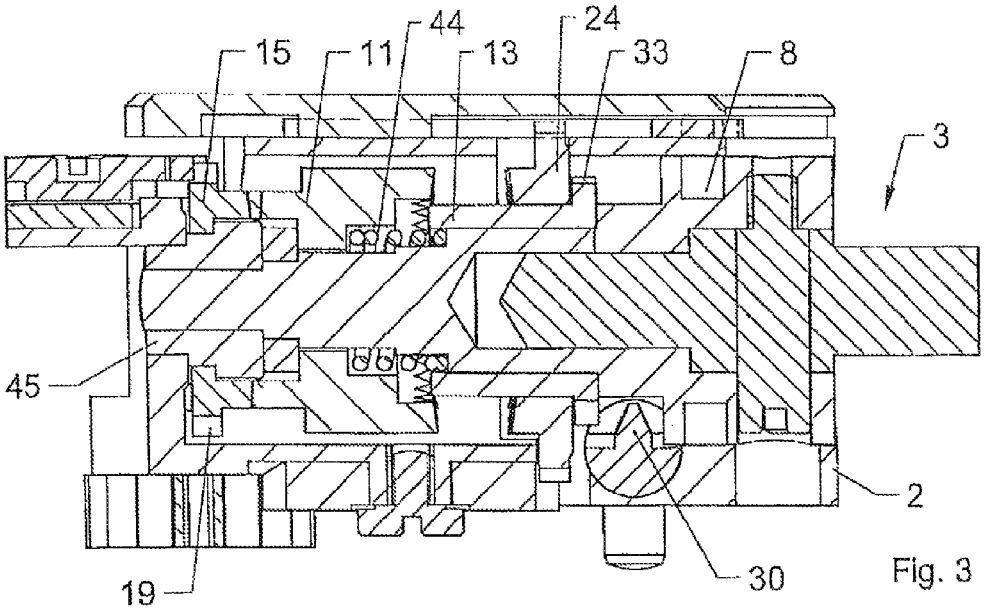
FIGS. 3 and 4 are a cross-sectional and top view of the module of the invention, respectively, the control stem being in a first winding position.
Figure 4:
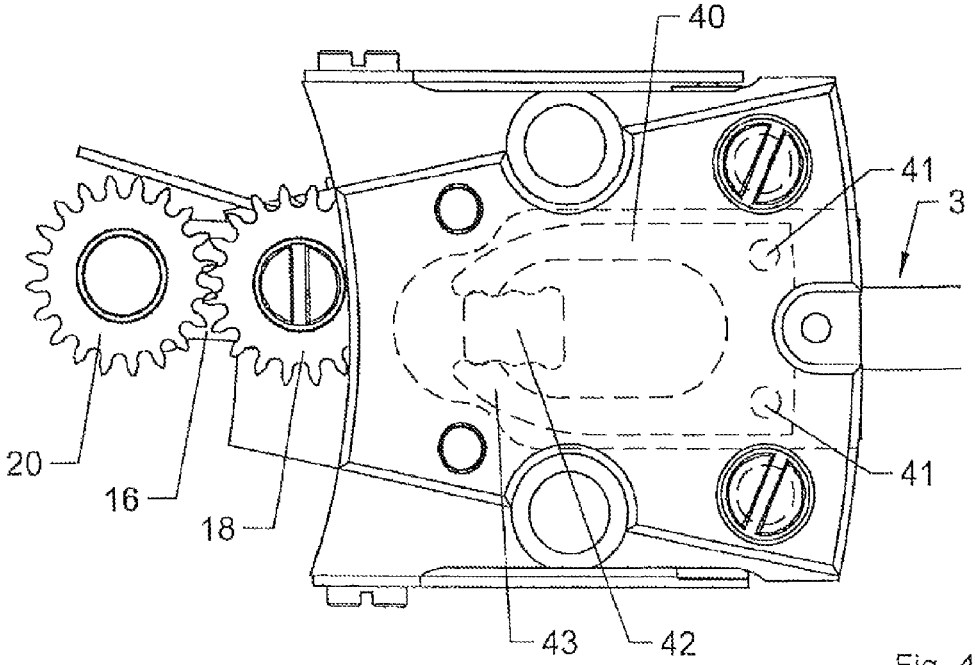

Most of the time, the mechanism is in the first winding position, shown in FIGS. 3 and 4. In this first position, the control stem 3 is pushed back to the bottom of the case 2 and the control pinion 11 is pressed against the winding pinion 15. The control pinion 11 does not engage with the setting wheel 24 and the toothed socket 13 does not engage with the rack 30. The ends 43 of the selector spring 40 are engaged in the first indexing element of the positioning organ 42 to keep the control stem in its first position. By making the control stem 3 rotate clockwise, the control pinion 11 secured to the control stem 3 rotates while driving the winding pinion 15 through the Breguet toothing 21. The toothing 19 of the winding pinion 15 then meshes with the intermediate wheel 18, which itself meshes with the intermediate wheel 20 that is kinematically connected to the ratchet fastened on the barrel arbor for winding. The rotationally movable tongue 16 makes it possible to make the module 1 best engage with the ratchet and allows disengagement in case of automatic winding, so that the control stem is not driven in rotation. If the control stem 3 is rotated in the opposite direction, the control pinion 11 disengages from the winding pinion 15.

Figure 6:
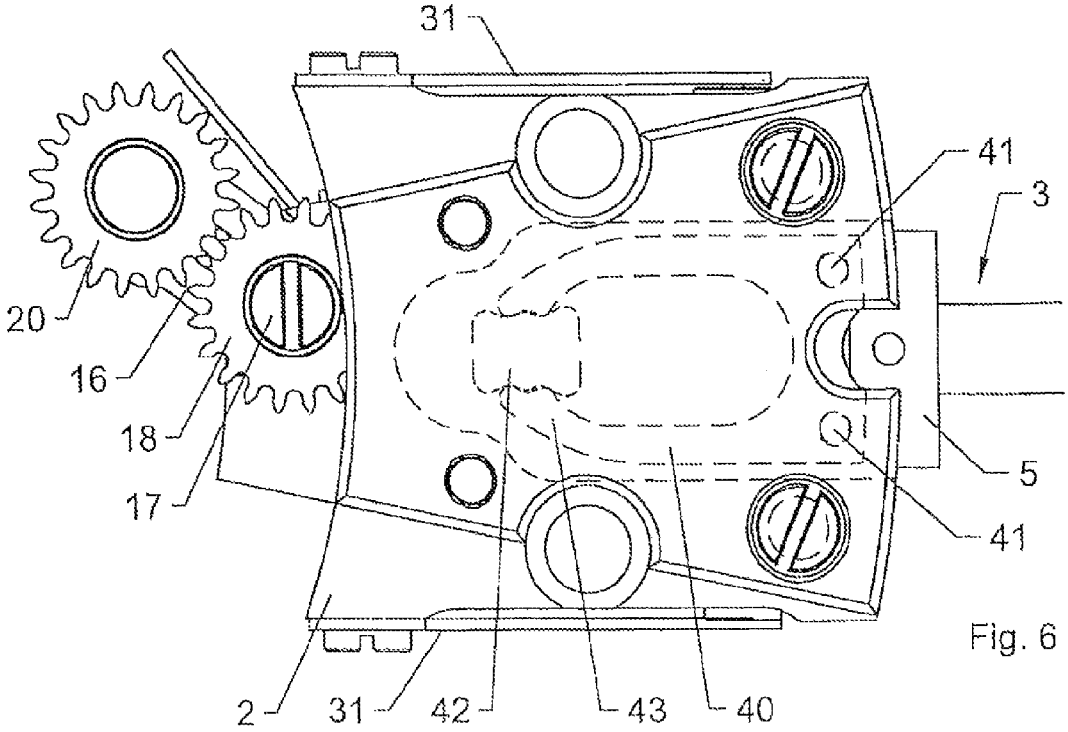

In reference to FIGS. 5 and 6, when the control stem 3 is pulled, the selector spring 40, driven by the pins 41 housed in the slot 8 of the control stem, moves in the same way until its ends 43 engage in the second indexing element of the positioning organ 42, thereby defining the second position corresponding to the actuation of a mechanism of the movement. During the translational movement of the control stem 3, the control pinion 11, stressed by the helical spring 44 and pushed by the ring 12, and the toothed socket 13, also translationally secured to the control stem, move in the same way until they occupy the second position. In this second position, the control pinion 11 is inactive and does not engage with the winding pinion 15 or the setting wheel 24. The toothing 33 of the toothed socket 13 engages with the toothing 32 of the rack 30. By rotating the control stem 3 in an alternating movement, the rack 30 and the actuating fingers 34 move perpendicularly to the control stem 3, in an alternating movement, to actuate an appropriate mechanism. By choosing the number of teeth, it is possible to impart a more or less long movement to the rack 30 and the actuating fingers 34. The strip springs 31 act like return springs. Moreover, a Person skilled in the art will know how to choose a suitable rack, so as to be able to make the control stem 3 rotate in a continuous movement instead of an alternating movement.

Figure 7:
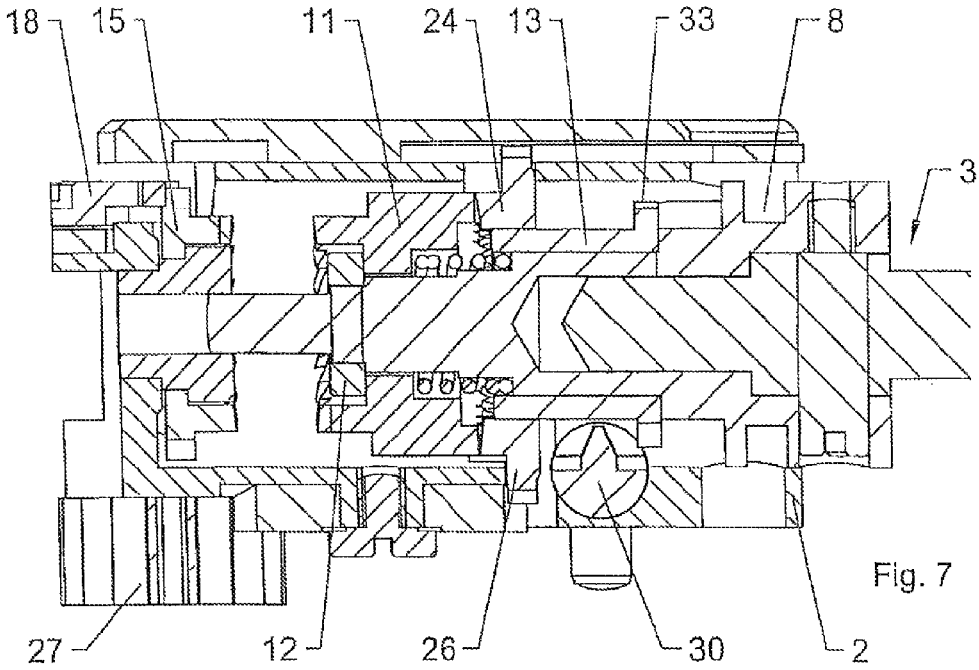
FIGS. 7 and 8 are a cross-sectional and top view of the module of the invention, respectively, the control stem being in a third setting position.
Figure 8:
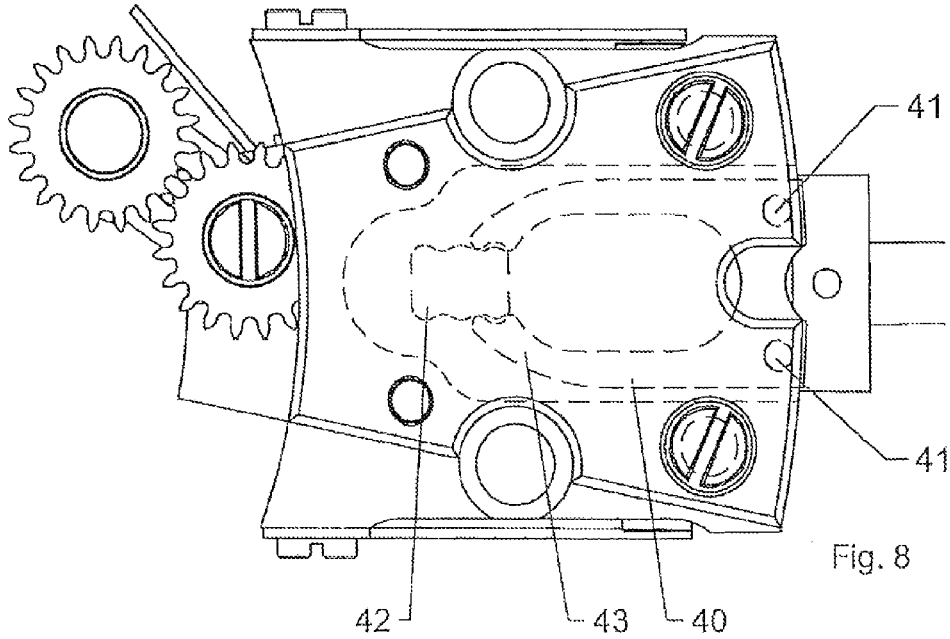

In references to FIGS. 7 and 8, when the control stem 3 is pulled again, the selector spring 40, driven by the pins 41 housed in the slot 8 of the control stem, moves in the same way until its ends 43 engage in the third indexing element of the positioning organ 42, thereby defining the third time correction position. During the translational movement of the control stem 3, the control pinion 11, stressed by the helical spring 44 and pushed by the ring 12, and the toothed socket 13, also translationally secured to the control stem 3, move in the same way until they occupy the third time correction position. In this third position, the control pinion 11 does not engage with the winding pinion 15 and the toothing 33 of the toothed socket 13 has passed through the toothing of the rack 30 so that the control pinion 11 engages with the setting wheel 24. By making the control stem 3 turn, the control pinion 11 integral with the control stem 3 rotates while driving the setting wheel 24 through the contrate toothings 22 and 23. The toothing 25 of the setting wheel 24 then meshes with the intermediate wheel 26 that itself meshes with the intermediate wheel 27, itself kinematically connected to display organs, to correct the time.

The positioning organ 42 is configured to allow the mechanism to be returned to the first position by pushing the control stem 3 without going through the second intermediate position.

Obviously the mechanism and the module according to the invention can comprise different combinations of control pinions and actuating organs, as described above. For example, it is possible to provide a mechanism and its module comprising one or several toothed sockets integral with the control stem configured to engage with different racks each actuating a different element of the movement. This mechanism may or may not comprise the control pinion able to engage with the winding pinion and/or the setting wheel. It is also possible to provide a winding and setting mechanism and its module, similar to that described above, but only comprising the control pinion able to engage with the winding pinion and/or the setting wheel. It is for example possible to provide a single control pinion engaging with two actuating organs, one to correct the time and the other for winding, or two racks each actuating a different element of the movement.

The invention claimed is:

1. A module for actuating an element of a timepiece movement, intended to be mounted on a frame of said movement, said module comprising:

a mechanism comprising a control stem mounted in a pivoting manner and movable between at least two axial positions;

a control pinion mounted so as to rotate with said control stem, said control pinion being translationally secured to said control stem when the control stem moves from one to the other of said two axial positions;

at least one actuating organ configured to engage with said control pinion when the control stem is occupying one of the axial positions;

an independent case in which said mechanism is contained; and a connector leaving the case and configured to be able to kinematically connect the actuating organ to an element of the movement to be actuated, such that said actuating organ can actuate said element.

2. The module according to claim 1, wherein the connector is mounted on the case so that the connector can be oriented.

3. The module according to claim 1, wherein the element to be actuated is made up of display organs, the corresponding actuating organ comprises a setting wheel mounted freely rotating with the control stem, and the control pinion comprises, on a face opposite the setting wheel, a toothing able to cooperate with the toothing of the setting wheel to correct the time.

4. The module according to claim 3, wherein the connector between the setting wheel and the display organs comprise at least one intermediate wheel mounted freely rotating on the case.

5. The module according to claim 1, wherein the element to be actuated is formed by a barrel spring, the corresponding actuating organ comprises a winding pinion configured to be able to be kinematically and at least temporarily connected to said barrel spring by the connector, said winding pinion being mounted freely rotating on the control stem, and the control pinion comprises, on its face opposite the winding pinion, a toothing able to engage with said winding pinion for the winding of said movement.

6. The module according to claim 5, wherein the connector between the winding pinion and the barrel spring comprises a tongue protruding from the case and mounted rotationally mobile on said case, said tongue supporting at least one intermediate wheel configured on one hand to mesh with the winding pinion and on the other hand to be able to be kinematically and at least temporarily connected to said barrel spring.

7. The module according to claim 5, wherein the mechanism comprises at least two actuating organs, one to correct the time and the other for winding, and wherein the control pinion is positioned such that, on the control stem, from an outside towards a center, are the setting wheel, the control pinion and the winding pinion.

8. The module according to claim 1, wherein the actuating organ comprises a rack able to move perpendicularly to the control stem in a bidirectional movement, said rack comprising the connecting means configured to engage with the element to be actuated, and the control pinion comprises a toothing able to engage with the toothing of the rack so as to move said rack and the rack's connector.

9. The module according to claim 8, wherein the toothing of the rack is chosen such that, in one position, the control pinion cooperates with the rack, and the control pinion can pass through the toothing of the rack to reach the other position.

10. The module according to claim 1, wherein the mechanism comprises a first control pinion for setting and winding and a second control pinion configured to engage with a rack to actuate another element of the timepiece movement, the first and second control pinions being positioned such that, on the control stem, from an outside towards a center, are the second control pinion, the setting wheel, the first control pinion and the winding pinion, and the control stem is movable between three axial positions, a first position according to which the first control pinion meshes with the winding pinion, a second position according to which the second control pinion meshes with the rack, and a third position according to which the first control pinion meshes with the setting wheel, the second control pinion having passed through the toothing of the rack.

11. The module according to claim 1, wherein the mechanism also comprises a selector spring cooperating with the control stem and with a positioning organ to define the positions of the control stem.

12. The module according to claim 1, wherein the control stem comprises a first removable element and a second element housed inside the case.

13. A timepiece movement mechanism, comprising:

a control stem mounted in a pivoting manner and movable between at least two axial positions;

a control pinion mounted so as to rotate with said control stem, said control pinion being translationally secured to said control stem when the control stem moves from one to the other of said two axial positions; and at least one actuating organ configured to engage with said control pinion when the control stem is occupying one of the axial positions, wherein the actuating organ is configured to be kinematically connected to display organs of a timepiece movement, and comprises a setting wheel mounted freely rotating on the control stem, and the control pinion comprises, on a face opposite the setting wheel, a toothing able to engage with the toothing of the setting wheel to correct the time.

14. The mechanism according to claim 13, wherein the mechanism comprises at least two actuating organs, one to correct the time and the other for winding, and wherein the control pinion is positioned such that, on the control stem, from an outside towards a center, are the setting wheel, the control pinion and the actuating organ for winding.

15. The mechanism according to claim 13, wherein the mechanism comprises a first control pinion for setting and winding and a second control pinion configured to engage with a rack to actuate another element of the timepiece movement, the first and second control pinions being positioned such that, on the control stem, from an outside towards a center, are the second control pinion, the setting wheel, the first control pinion and the winding pinion, and wherein the control stem is movable between three axial positions, a first position according to which the first control pinion meshes with the winding pinion, a second position according to which the second control pinion meshes with the rack, and a third position according to which the first control pinion meshes with the setting wheel, the second control pinion having passed through the toothing of the rack.

16. A timepiece, comprising:

a module for actuating an element of a timepiece movement, intended to be mounted on a frame of said movement, said module containing:

a mechanism comprising a control stem mounted in a pivoting manner and movable between at least two axial positions, a control pinion mounted so as to rotate with said control stem, said control pinion being translationally secured to said control stem when the control stem moves from one to the other of said two axial positions, at least one actuating organ configured to engage with said control pinion when the control stem is occupying one of the axial positions, an independent case in which said mechanism is contained, and a connector leaving the case and configured to be able to kinematically connect the actuating organ to the element of the movement to be actuated, such that said actuating organ can actuate said element.

* * * * *

UNITED STATES PATENT AND TRADEMARK OFFICE

CERTIFICATE OF CORRECTION

PATENT NO. : 8,641,269 B2
APPLICATION NO. : 12/993972
DATED : February 4, 2014
INVENTOR(S) : Girardin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 496 days.

Signed and Sealed this
Twenty-second Day of September, 2015

Michelle K. Lee

Michelle K. Lee
*Director of the United States Patent and Trademark Office*